US005463912A

United States Patent [19]

Inoue et al.

[11] Patent Number: 5,463,912

[45] Date of Patent: Nov. 7, 1995

[54] LEVER-OPERATED CONNECTOR

[75] Inventors: Nori Inoue; Hitoshi Okumura; Hiroyuki Nakata, all of Yokkaichi, Japan

[73] Assignee: Sumitomo Wiring Systems, Ltd., Mie, Japan

[21] Appl. No.: 217,111

[22] Filed: Mar. 24, 1994

[30] Foreign Application Priority Data

Mar. 30, 1993 [JP] Japan ..... 5-097180

[51] Int. Cl.[6] ..... H01R 13/629

[52] U.S. Cl. ..... 74/519; 439/157; 439/372; 403/321

[58] Field of Search ..... 74/519; 403/321, 403/329, 375; 439/152, 153, 157, 160, 310, 372

[56] References Cited

U.S. PATENT DOCUMENTS 4,530,615 7/1985 Katsuura et al. ..... 439/157 X
5,135,410 8/1992 Kawase et al. ..... 439/157 X
5,308,255 5/1994 Yamanashi ..... 439/157
5,330,411 7/1994 Fujitani et al. ..... 439/157

FOREIGN PATENT DOCUMENTS 0459488 12/1991 European Pat. Off. .
0532366 3/1993 European Pat. Off. .
4-62772 2/1992 Japan .
2179506 3/1987 United Kingdom .

*Primary Examiner*—Richard M. Lorence
*Attorney, Agent, or Firm*—Oliff & Berridge

[57] ABSTRACT

A lever-operated connector is connected together by using a lever. The lever has pins. The connector housing includes positioning notches for positioning the pins of the lever to insert, slanting guide surfaces arranged beneath the notches for elastically deforming the lever according to inserting the pins into the slanting guide surfaces, and bearing holes arranged beneath the slanting guide surfaces for receiving and pivotally supporting the pins of the lever.

12 Claims, 7 Drawing Sheets

LEVER-OPERATED CONNECTOR

BACKGROUND OF THE INVENTION

This invention relates to one of a pair of lever-operated connectors in which connectors are connected together through leverage of a lever, and the assembly of the lever is improved.

A pair of lever-operated connectors, in which connectors are connected together through leverage of a lever, has an advantage in that connection and disconnection can be effected with a small force, and this type of connector has been extensively applied to multi-terminal connectors in which resistance produced for fitting terminals together is large.

In such a conventional connector as shown in FIG. 13, bearing holes 72, formed in a lever 70, are pivotally fitted respectively on a pair of pins 62 formed respectively on opposite outer sides of a hood portion 61 of a male connector housing 60, thus assembling the lever 70 astride the male connector housing 60.

In such a conventional connector, the procedure of assembling the lever will now be described with reference to FIGS. 14(A)–(C). First, as shown in FIG. 14(A), the proximal ends of arms 71 of the lever 70 are brought into contact with the pins 62 of the male connector housing 60, respectively, and then the lever 70 is urged hard against the male connector housing 60 to cause the pins 62 to be disposed between the two arms 71, thereby elastically deforming the two arms 71 away from each other. In this condition, when the lever 70 is further moved, the bearing holes 72 in the lever 70 are fitted on the pins 62 of the male connector housing 60, respectively, as shown in FIG. 14(B).

At this time, for elastically deforming the arms 71 held against the pins 62, the lever 70 is urged with a considerably large force, and therefore the lever 70 moves vigorously simultaneously when the arms 71 are moved away from each other. As a result, the bearing holes 72 sometimes pass over the pins 62, so that cam grooves 73 are fitted on the pins 62, respectively, as shown in FIG. 14(C). In this condition, the lever 70 must be removed, and assembling of the lever must be carried out again. This requires much time and troublesome work.

Furthermore, when the urging direction of the lever 70 inadvertently deviates from the proper direction, the position of the pins 62 which are disposed inwardly of the arms 71, can not be visually confirmed even if the cam grooves 73 are not fitted on the pins 62, respectively. In this condition, depending on intuition, the lever 70 must be moved in the proper direction in search for the position of the pins 62 so that the bearing holes 72 can be fitted respectively on the pins 62, and therefore, it is quite possible that the operation becomes difficult.

SUMMARY OF THE INVENTION

The present invention has been made in view of the foregoing, and an object of the invention is to provide a pair of lever-operated connectors in which pins can be accurately fitted in bearing holes, respectively, and the efficiency of assembling a lever can be enhanced.

To achieve the above mentioned object, the present invention provides a pair of lever-operated connectors, which are connected together by using a lever, the one connector comprising a connector housing and the lever for connecting the two connectors. The lever has pins. The connector housing of the one connector comprises positioning notches for positioning the pins of the lever to insert, slanting guide surfaces arranged beneath the notches for elastically deforming the lever according to inserting the pins into the slanting guide surfaces, and bearing holes arranged beneath the slanting guide surfaces for receiving and pivotally supporting the pins of the lever.

In the lever-operated connectors of the above construction, for assembling the lever to the connector housing, the pins of the lever are first fitted respectively in the positioning notches, and in this condition the lever is moved in a direction to insert the pins into the respective bearing holes in the connector housing. The lever is engaged with and guided along the slanting guide surfaces, and therefore is moved while subjected to elastic deformation. As a result, the pins approach the bearing holes, respectively, and are finally inserted in the bearing holes, respectively, so that the lever is mounted on the connector housing for pivotal movement about the pins.

In the assembling of the lever, the slanting guide surfaces which are formed on the connector housing enable the lever to easily elastically deform even if the lever is urged without a strong force. Therefore, there is no need to apply a large force to the lever, and there is no fear that the lever will move excessively, and the pins will not pass over the bearing holes.

The positioning notches formed in the connector housing cooperate with the slanting guide surfaces to guide the lever so that the pins can be moved toward the bearing holes, respectively. Therefore, even if the position of the pins and the position of the bearing holes can not be confirmed visually, the pins can be positively inserted into the bearing holes, respectively.

Thus, in the lever-operated connector of the present invention, the pins of the lever can be positively inserted respectively in the bearing holes in the connector housing, and therefore there is achieved an advantage that the lever-assembling operation can be positively effected with less time and troublesome work.

DETAILED DESCRIPTION OF THE PREFERRED EMBODIMENTS

Figure 1:
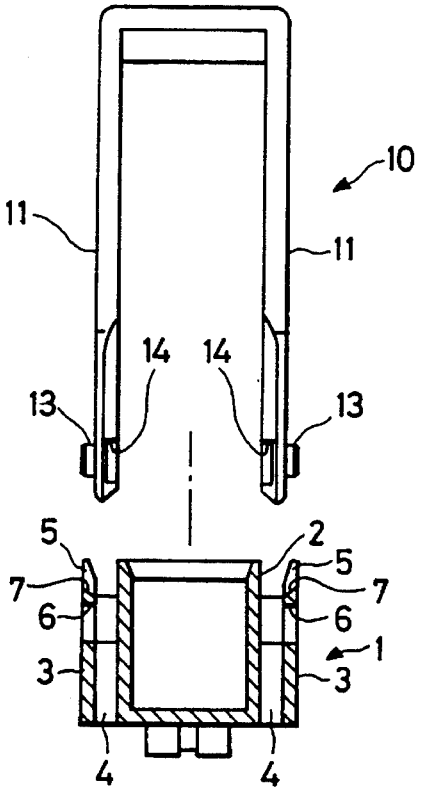
FIG. 1 is a vertical cross-sectional view of a first embodiment of the present invention, showing a condition before a lever is mounted.
Figure 2:
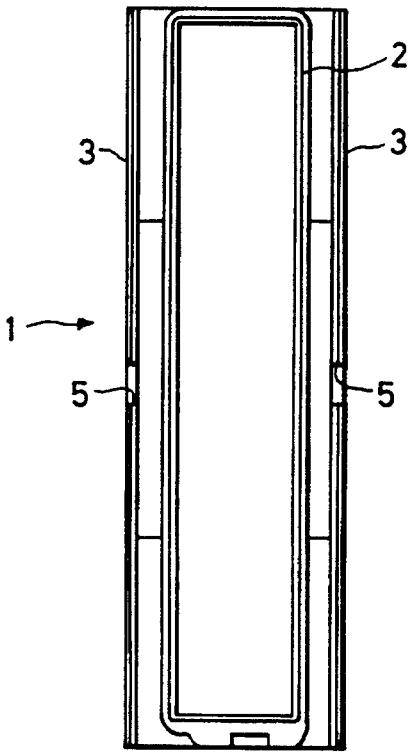
FIG. 2 is a plan view of a male connector housing.
Figure 3:
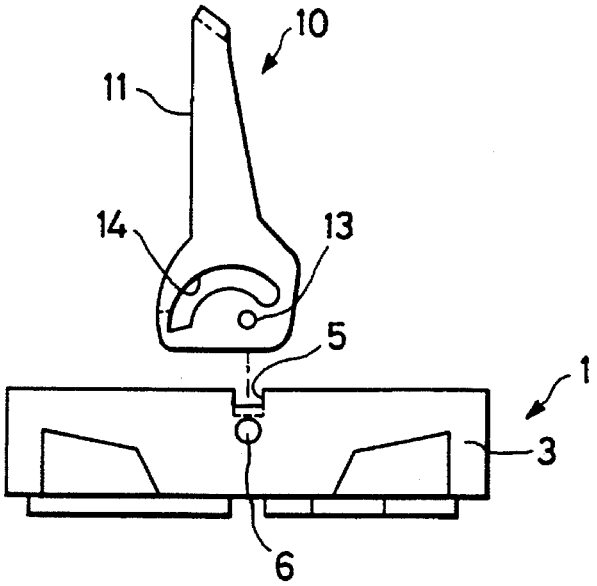
FIG. 3 is a side-elevational view showing a condition before the lever is mounted.

A first embodiment of the present invention will now be described with reference to FIGS. 1 to 7.

A first embodiment of a lever-operated connector according to the present invention comprises a male connector housing 1, a lever 10, and a female connector housing (not shown). The lever 10 is pivotally mounted on the male connector housing 1 by means later described, and the female connector housing is connected to the male connector housing 1 through leverage of the lever 10. The assembly of the lever 10 on the male connector housing 1 will now be described in detail.

The male connector housing 1 is made of a synthetic resin material, and includes an upwardly-open hood portion 2 of a square cross-section having male terminals (not shown) which are mounted on an inner bottom surface thereof, and outer walls 3 provided respectively outwardly of opposite outer side surfaces of the hood portion 2 in spaced relation thereto. The space between each outer surface of the hood portion 2 and the outer wall 3 serves as a lever insertion space 4 for inserting the lever 10 thereinto.

An upper edge of each of the outer walls 3 is notched downwardly at a central portion thereof to serve as a positioning notch 5 of a predetermined width. A circular bearing hole 6, which has a diameter generally equal to the width of the positioning notch 5, is formed through each outer wall 3 from its inner surface to its outer surface. And the circular bearing hole is disposed beneath the positioning notch 5, that is, spaced a slight distance from the notch 5. A slanting guide surface is formed between the positioning notch 5 and the bearing hole 6 such that a slanting surface extends from the lower edge of the positioning notch 5 at the outer surface of the outer wall 3 to the upper end of the bearing hole 6 at the inner surface of the outer wall 3. Namely, this slanting guide surface is slanting from the outer side of the outer wall 3 toward the lever insertion space 4.

The lever 10 is made of a synthetic resin material, and has such a configuration that a pair of plate-like arms 11 are interconnected at their distal ends. The distance between the outer surfaces of the two arms 11 is equal to the distance between the inner surfaces of the outer walls 3 of the male connector housing 1. Pins 13 of a circular shape are formed respectively on the outer surfaces of the proximal end portions of the two arms 11, and are disposed coaxially with each other. The diameter of each pin 13 is slightly smaller than the width of the positioning notch 5 in the male connector housing 1, and is slightly smaller than the diameter of the bearing hole 6.

A cam groove 14, which is an arcuate shape is formed through the proximal end portion of each arm 11 generally in surrounding relation to the pin 13 such that the distance between this cam groove and the pin 13 varies in the direction of the length of the arc of this cam groove. Cam reception projections, which are formed on an outer surface of the female connector housing (not shown), are engaged respectively in the cam grooves 14, and the position of this engagement is shifted in accordance with the pivotal movement of the lever 10, thereby achieving the leverage.

In the above construction, the operation for assembling the lever 10 on the male connector housing will now be described.

Figure 4:
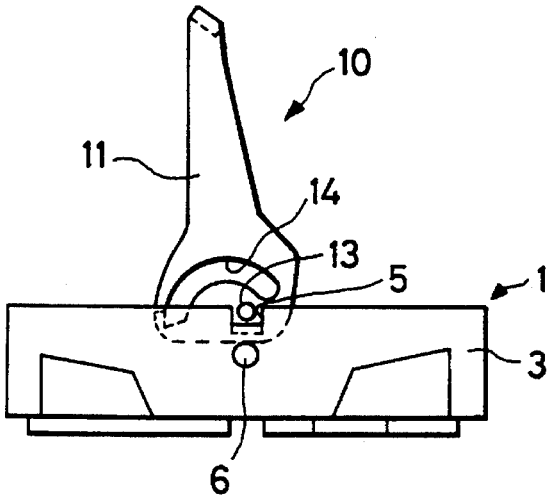
FIG. 4 is a side-elevational view showing a condition in the process of assembling of the lever.
Figure 5:
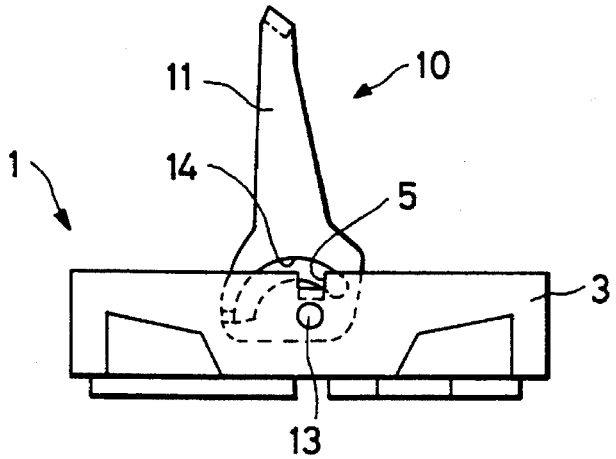
FIG. 5 is a side-elevational view showing a condition after the lever is mounted.
Figure 6:
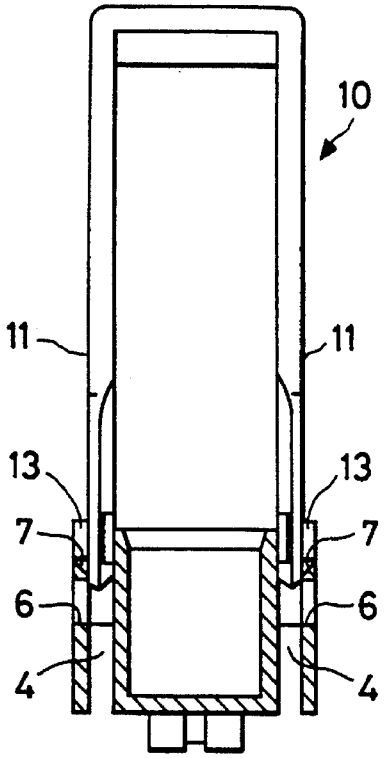
FIG. 6 is a vertical cross-sectional view showing the condition of FIG. 4.
Figure 7:
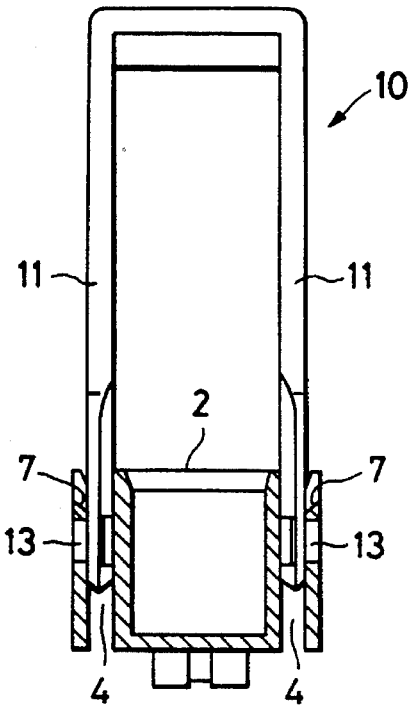
FIG. 7 is a vertical cross-sectional view showing the condition of FIG. 5.

First, the proximal end portions of the arms 11 of the lever 10 are inserted respectively into the lever insertion spaces 4, and the pins 13 of the lever 10 are fitted respectively in the positioning notches 5 of the male connector housing 1 from the upper side, as shown in FIGS. 4 and 6. At this time, if the lever 10 is positioned in such a manner that the arms 11 are upstanding, a subsequent operation for urging the lever 10 can be effected more easily.

In this condition, when the lever 10 is urged downwardly to be moved toward the inner ends of the lever insertion spaces 4, the tip of each pin 13 is brought into sliding contact with the slanting guide surface 7 in accordance with the downward movement of the lever 10. As a result, one or both of an inwardly-flexing elastic deformation, which reduces the distance between the arms 11, and an outwardly-flexing elastic deformation, which spread out the outer walls 3, outwardly occur. At this time, even if the direction of urging of the lever 10 inadvertently deviates from the proper direction, each pin 13 abuts against a side edge of the positioning notch 5, so that the direction of movement of the lever 10 is corrected. Therefore, the pins 13 of the lever 10 are positively guided to move toward the bearing holes 6, respectively.

In the assembly described above, even if the lever 10 is not urged with a strong force, the slanting guide surfaces 7 enable the lever 10 to elastically deform and the outer walls 3 to allow the downward movement of the lever 10, and therefore, it is not necessary to urge the lever 10 with a large force. Therefore, the lever 10 will not be moved excessively, and the pins 13 will not pass over the bearing holes 6, respectively, and each pin 13 is fitted in the bearing hole 6 immediately after the pin 13 passes over the slanting guide surface 7. Simultaneously with fitting each pin 13 in the bearing hole 6, one or both of the lever 10 and each outer wall 3 are elastically restored, so that the lever 10 is mounted on the male connector housing 1 for pivotal movement about the pins 13.

Thus, the insertion of the pins 13 into the respective bearing holes 6 can be effected easily and positively, and therefore the operation need not be repeated because of failure in the insertion, and much time and troublesome work will not be required for the operation, and the efficiency of the operation for assembling the lever 10 is quite high.

Particularly, in the first embodiment, the pins 13 are provided on the outer surfaces of the lever 10, and the positioning notches 5 and the bearing holes 6 are open to the outer surfaces of the outer walls 3, which are the outermost sides of the male connector housing 1. Therefore, the condition of fitting of each pin 13 in the positioning notch 5, as well as the position of each bearing hole 6 for receiving the pin 13, can be grasped visually. Therefore, the lever 10 can be positively moved in the proper direction so as to bring each pin 13 toward the bearing hole 6, and there is no fear that the lever 10 is moved in a wrong direction.

In this first embodiment, the bearing holes 6 are open to the outer surfaces of the outer walls 3, which are the outermost sides of the male connector housing 1, and therefore when the lever 10 is attached, whether or not the pins 13 are fitted respectively in the bearing holes 6, can be confirmed visually. Therefore, for example, even if the pin 13 is accidentally engaged with a convex or a concave portion within the lever insertion space 4, so that the lever 10 is pivotally moved about those portions deviated from the bearing holes 6, the operator can find such a defective assembling of the lever 10.

In this first embodiment, the bearing holes 6 are formed respectively through the outer walls 3, and therefore in the formation of the bearing holes 6, by the use of a mold having projections for forming the bearing holes 6 on those surfaces corresponding respectively to the outer surfaces of the outer walls 3, the mold can be easily removed after the molding merely by withdrawing it from the bearing holes 6, thus providing excellent moldability.

Furthermore, in this first embodiment, the bearing holes 6 are formed respectively through the outer walls 3 separate from the hood portion 2 for receiving the female connector housing, and therefore when the lever 10 is to be mounted, the elastic deformation of the male connector housing 1, caused by the abutment of the pins 13 against the slanting guide surfaces 7, develops not in the hood portion 2 but in the outer walls 3. Therefore, there is no fear that the hood portion 2 is subjected to plastic deformation resulting from elastic deformation, so that the fitting of the female connector housing into the hood portion 2 will not be adversely affected.

Figure 8:
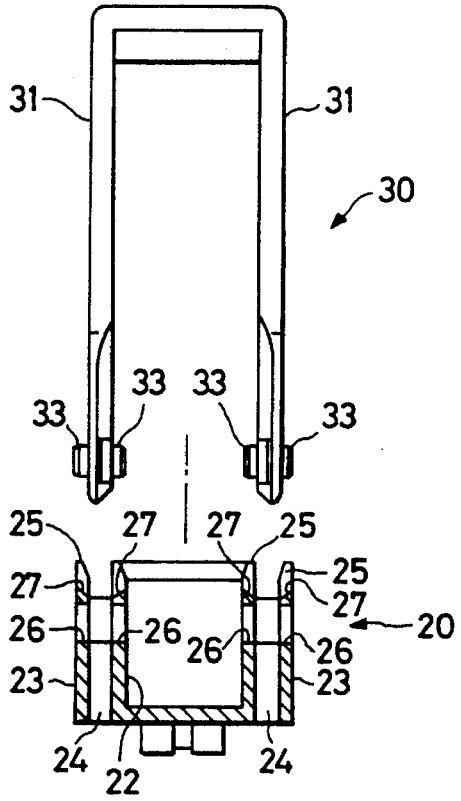
FIG. 8 is a vertical cross-sectional view of a second embodiment of the present invention, showing a condition before a lever is mounted.
Figure 9:
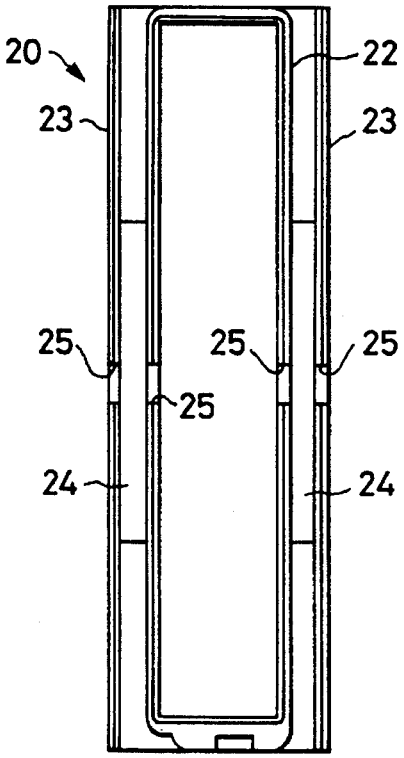
FIG. 9 is a plan view of a male connector housing of the second embodiment.

Next, a second embodiment of the present invention will now be described with reference to FIGS. 8 and 9.

A lever 30 includes two arms 31 each having coaxial pins 33 formed respectively on inner and outer surfaces thereof. Outer walls 23 of a male connector 20 have bearing holes 26 for respectively receiving the pins 33 on the outer surfaces of the lever 30, positioning notches 25 and slanting guide surfaces 27, as in the first embodiment. Opposite side walls of a hood portion 22 respectively have bearing holes 26 that are coaxial with the bearing holes 26 in the outer walls 23 and adapted to receive the pins 33 on the inner surfaces of the lever 30, positioning notches 25 corresponding to the positioning notches 25 in the outer walls 23, and slanting guide surfaces 27 each defined by a slanting surface which is disposed in opposed relation to the slanting guide surface 27 of a respective one of the outer walls 23 and extends downwardly from the inner side of the hood portion 22 toward a lever insertion space 24 provided outwardly of the hood portion.

For assembling the lever 30, the arms 31 of the lever 30 are inserted respectively into the lever insertion spaces 24 to fit the pins 33 of the lever 30 in the positioning notches 25, which are formed in the outer walls 23 and the hood portion 22, and the lever 30 is urged toward the inner ends of the lever insertion spaces 24. As a result, the pins 33 are held in sliding contact with the respective slanting guide surfaces 27 to elastically deform one or all of the lever 30, the outer walls 23 and the hood portion 22, and the pins 33 are guided toward the respective bearing holes 26. The outer pins 33 and the inner pins 33 are fitted respectively in the bearing holes 26 of the outer walls 23 and the bearing holes 26 of the hood portion 22 at the same time, thus completing the assembling operation.

Figure 10:
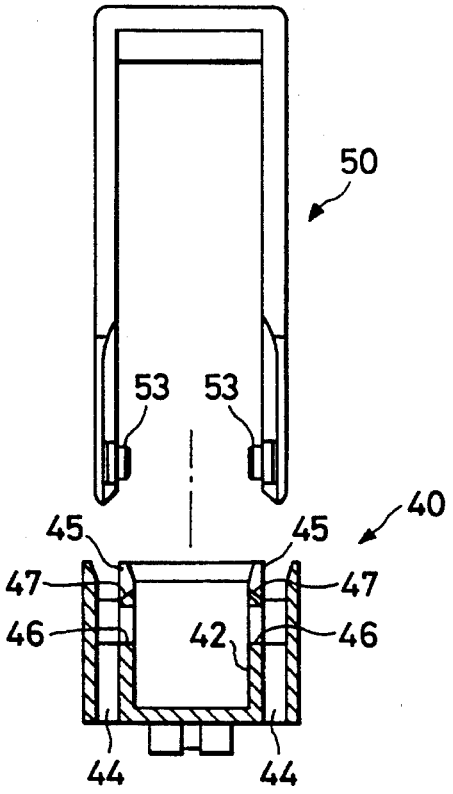
FIG. 10 is a vertical cross-sectional view of a third embodiment of the present invention, showing a condition before a lever is mounted.
Figure 11:
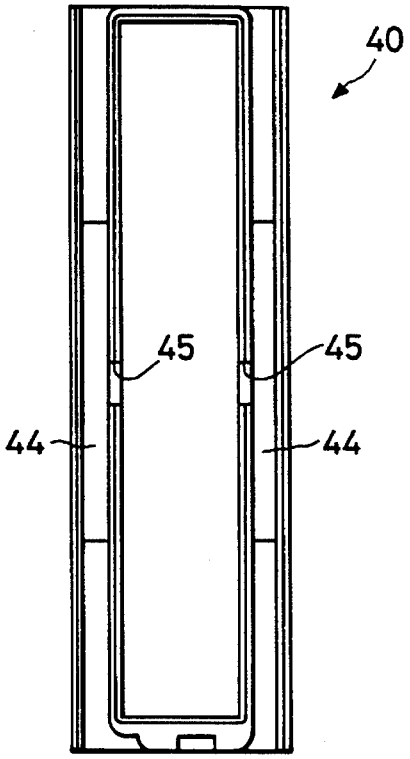
FIG. 11 is a plan view of a male connector housing of the third embodiment.
Figure 12:
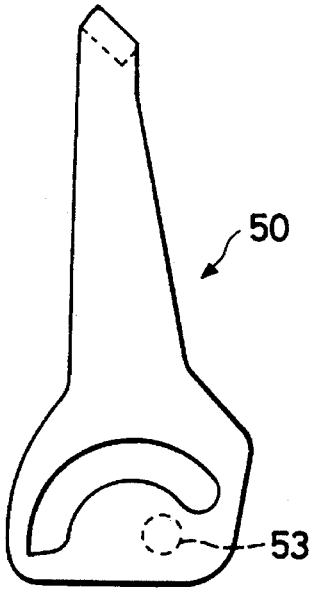
FIG. 12 PRIOR ART
FIG. 12 is a side-elevational view of a lever of the third embodiment.
Figure 13:
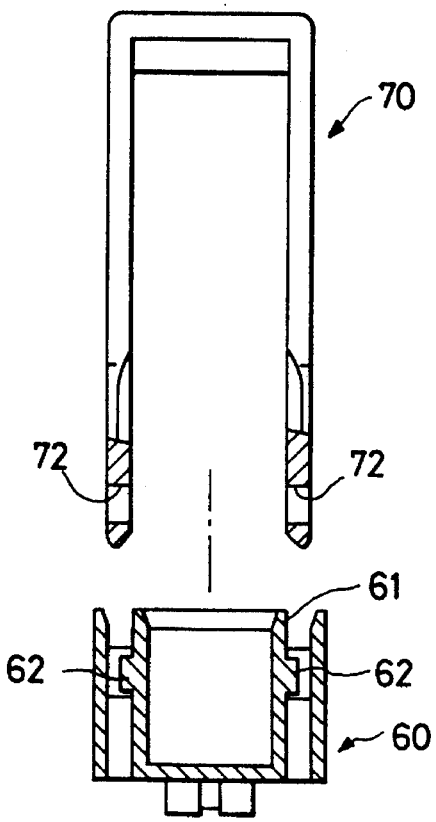
FIG. 13 PRIOR ART
FIG. 13 is a vertical cross-sectional view of one of conventional lever-operated connectors, showing a condition before a lever is mounted.
Figure 14A:
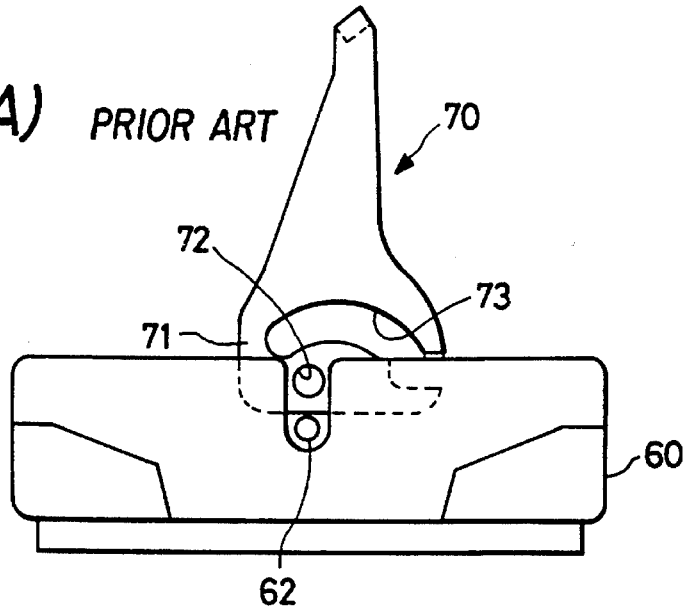
FIG. 14(A) PRIOR ART
FIGS. 14(A), (B) and (C) are side-elevational views, showing a problem encountered when assembling the lever of the conventional lever-operated connector.
Figure 14B:
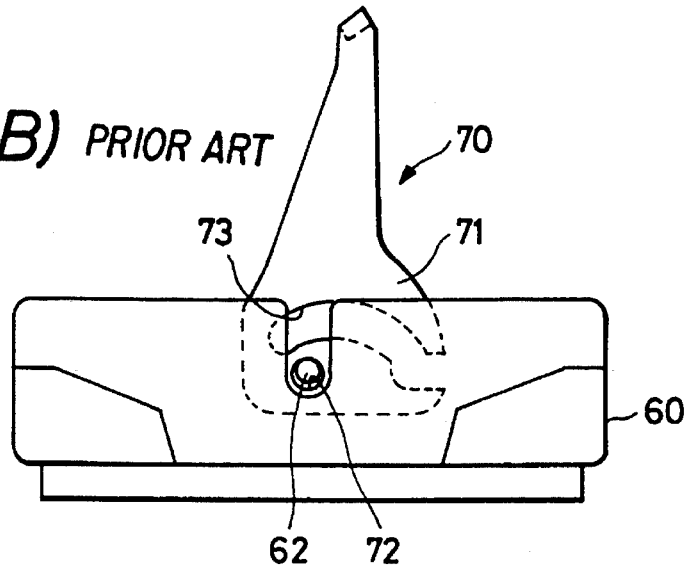
FIG. 14(B) PRIOR ART
Figure 14C:
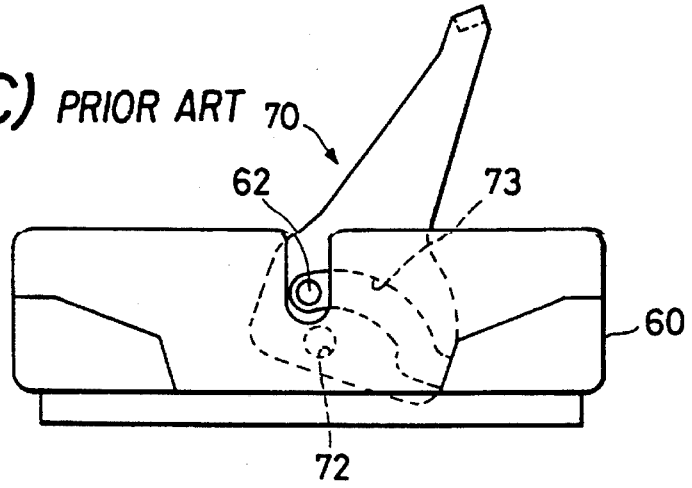
FIG. 14(C) PRIOR ART

A third embodiment of the present invention will now be described with reference to FIGS. 10 to 12.

In the above first embodiment, the pins 13 are formed on the outer surfaces of the lever 10. The bearing holes 6, the positioning notches 5 and the slanting guide surfaces 7 are provided at the outer walls 3 separate from the hood portion 2, which receives the female connector housing. In this third embodiment, in contrast with such arrangement, pins 53 are formed respectively on inner surfaces of a lever 50. The bearing holes 46, positioning notches 45 and slanting guide surfaces 47 are provided at a hood portion 42 of a male connector housing 40.

For assembling the lever 50, arms 51 of the lever 50 are inserted respectively into lever insertion spaces 44 to fit the pins 53 respectively in the positioning notches 45 in the hood portion 42, and the lever 50 is urged toward the inner ends of the lever insertion spaces 44. The pins 53 are moved while elastically deforming one or both of the lever 50 and the hood portion 42 as a result of sliding contact of the pins 53 with the respective slanting guide surfaces 47 so that the pins 53 are fitted respectively in the bearing holes 46 in the hood portion 42.

The present invention is not limited to the above embodiments, and for example the invention can be modified in the following manner.

(a) In the above embodiments, although the male connector housing has the outer walls provided outwardly of the hood portion for receiving the female connector housing, the male connector housing may not be provided with the outer walls, and therefore may comprise only the hood portion, in which case the bearing holes, the positioning notches and the slanting guide surfaces are formed in the hood portion.

(b) In the above embodiments, although the lever is mounted on the male connector housing, the lever may be mounted on the female connector housing.

Furthermore, the present invention is not limited to the embodiments mentioned above and shown in the drawings, and various modifications can be made without departing from the scope of the invention.

What is claimed is:

1. A lever-operated connecter, comprising:

a connector housing including:

a hood portion having an outer surface, an outer wall having an inner and outer surface, said outer wall in a spaced relation to the outer surface of said hood portion forming a lever insertion space therebetween, a pair of positioning notches disposed coaxially with each other on said outer wall, a pair of bearing holes, each bearing hole formed through the inner and outer surface of said outer wall and disposed beneath each positioning notch, a pair of slanting guide surfaces, each slanting guide surface formed between each positioning notch and each bearing hole, said slanting guide surface extending from a lower edge of each positioning notch at the outer surface of said outer wall to an upper end of each bearing hole at the inner surface of said outer wall; and a lever including:

a pair of arms, each arm having a proximal end portion and distal end portion with respect to said housing, and a pair of pins, each pin formed on the outer surface of the proximal end portion of each arm and disposed coaxially with each other.

2. A pair of lever-operated connectors according to claim 1, wherein said positioning notches, said slanting guide surfaces, and said bearing holes are formed on the outer surface of said hood portion, and said pins are formed on the inner surface of the proximal end portion of each arm and disposed coaxially with each other.

3. A pair of lever-operated connectors according to claim 1, wherein said positioning notches, said slanting guide surfaces, and said bearing holes are formed on the outer surface of said hood portion and on the inner surface of said outer wall, and said pins are formed on the inner and outer surface of the proximal end portion of each arm and disposed coaxially with each other.

4. The connecter of claim 1, further comprising a pair of arcuate-shaped cam grooves, each cam groove formed through the proximal end portion of each arm.

5. The connector of claim 4, wherein a distance between each cam groove and the pin disposed on the same proximal end portion varies in the direction of the length of the arc of each cam groove.

6. The connector of claim 1, wherein said connector housing is comprised of synthetic resin material.

7. The connector of claim 1, wherein said lever is comprised of synthetic resin material.

8. The connector of claim 1, wherein said outer wall further includes a central portion, and wherein said positioning notches are located at the central portion.

9. The connector of claim 1, wherein a diameter of each bearing hole is substantially equal to a width of each positioning notch.

10. The connector of claims 1, wherein a distance between the inner surface of said outer wall is substantially equal to a distance between the outer surfaces of each arm.

11. The connector of claim 1, wherein each arm is interconnected at the distal end to form a generally U-shaped configuration.

12. The connector of claim 1 wherein a diameter of each pin is smaller than a width of each positioning notch and each bearing hole.

* * * * *